United States Patent [19]

Yoshitomi

[11] Patent Number: 4,886,191

[45] Date of Patent: Dec. 12, 1989

[54] TOOL FOR ASSISTING SPRAY WORK AT HIGH POSITION

[75] Inventor: Shingo Yoshitomi, Ikeda, Japan

[73] Assignee: Kabushiki Kaisha Araki Gomu, Osaka, Japan

[21] Appl. No.: 177,754

[22] Filed: Apr. 5, 1988

Related U.S. Application Data

[62] Division of Ser. No. 81,425, Aug. 4, 1987, Pat. No. 4,789,084.

[30] Foreign Application Priority Data

Dec. 19, 1986 [JP] Japan ..... 61-304964
May 16, 1987 [JP] Japan ..... 62-119326

[51] Int. Cl.[4] ..... B67D 5/64

[52] U.S. Cl. ..... 222/174; 403/109; 403/350

[58] Field of Search ..... 248/188.5, 412; 403/109, 289–290, 350–351, 377; 222/174, 402.15; 239/281, 532

[56] References Cited

U.S. PATENT DOCUMENTS

| | | | |
|---|---|---|---|
| 2,720,422 | 10/1955 | Mercur | 222/174 |
| 3,034,798 | 5/1962 | Portz | 403/290 X |
| 3,039,657 | 6/1962 | Meuwly | 222/174 |
| 3,220,613 | 11/1965 | Palmer et al. | 222/174 |
| 3,510,028 | 5/1970 | Batistelli | 222/174 |
| 3,549,054 | 12/1970 | Etter | 222/180 |
| 3,679,319 | 7/1972 | Munchel et al. | 401/138 |
| 3,856,209 | 12/1974 | Hickson | 239/532 |
| 4,023,711 | 5/1977 | Sena | 222/174 |
| 4,089,440 | 5/1978 | Lee | 222/174 |
| 4,154,545 | 5/1979 | Pinto et al. | 403/104 |
| 4,262,821 | 4/1981 | Smrt | 222/162 |
| 4,412,656 | 11/1983 | Beck | 239/373 |
| 4,457,472 | 7/1984 | Geberth, Jr. | 239/532 |

FOREIGN PATENT DOCUMENTS 1262782 2/1972 United Kingdom .

*Primary Examiner*—Michael S. Huppert
*Attorney, Agent, or Firm*—Armstrong, Nikaido, Marmelstein, Kubovcik & Murray

[57] ABSTRACT

A tool for assisting spray work at a high position which includes a pole, a holder for holding a spray device at an upper portion of the pole, a valve-opening mechanism for opening an ejecting valve of the spray device, and an operating mechanism for remotely operating the valve-operating mechanism from a lower portion of the pole. The holder for holding the spray device at an upper portion of the pole includes an upper holder fixed on the upper end of the pole, laterally extending and having a fitting portion for holding a neck portion of the spray device, and a lower holder having a tubular portion slidably mounted on the pole, an arm laterally extending from the tubular portion, and a receiving portion provided at a free end of the arm. The receiving portion supports the lower center surface of the spray device. A clamping mechanism is provided for fixing the tubular portion on the pole.

5 Claims, 12 Drawing Sheets

TOOL FOR ASSISTING SPRAY WORK AT HIGH POSITION

This is a continuation of application Ser. No. 081,425 filed Aug. 4, 1987, now U.S. Pat. No. 4,789,084.

BACKGROUND OF THE INVENTION

The present invention relates to a tool for assisting spray work at a high position. More particularly, the present invention relates to a tool adapted to be used when insecticide, fungicide, paint, cleaning material, or the like is sprayed at tall trees, high wall surfaces, ceilings, panes in high position, panes of a show window, or the like.

There has been hitherto known no particular tool adapted to assist a spray work for high objects, e.g. the ceiling or high walls, trees, window panes or show windows.

Therefore the user must grip a spray device with his hand, and a step such as a stepladder is utilized when high objects are sprayed. However, such manner requires very troublesome works for preparing the stepladder and for moving the stepladder at any time the user shifts his position for spraying. Further, the work is not always safe.

The object of the present invention is to provide a convenient tool for assisting the spray work at a high position.

SUMMARY OF THE INVENTION

The tool for assisting spray work at a high position of the present invention comprises a pole, a holder for holding a spray device at the upper end portion of the pole, a valve-opening mechanism for opening an ejecting valve of the spray device, and an operating means for remotely operating the valve-opening mechanism from the lower end portion of the pole.

The pole in the present invention serves for positioning the spray device supported on the upper end thereof, by holding the lower portion of the pole with user's hands. The length of the pole can be optionally selected in accordance with the purpose of the spray work. If the length of the pole is too short, the assisting tool itself becomes useless. On the contrary, if the length is too long, the spray work becomes inconvenient. Therefore, a pole having a length of about 1 to 5 m is preferably employed.

In the tool of the present invention, when the tool is highly elevated by holding the lower end of the pole, the spray device can be positioned at a high position. Under the condition, by operating the operating means to shift the valve-opening mechanism, the ejecting valve can be opened.

When the ejecting valve is opened as mentioned above, the contents of the spray device can be sprayed out. Therefore, by utilizing the assisting tool of the present invention, a spray work at high position can be easily performed.

Hereinafter, some embodiments of the present invention will be explained in detail with reference to the accompanying drawings.

DETAILED DESCRIPTION OF THE INVENTION

First Embodiment

Figure 1:
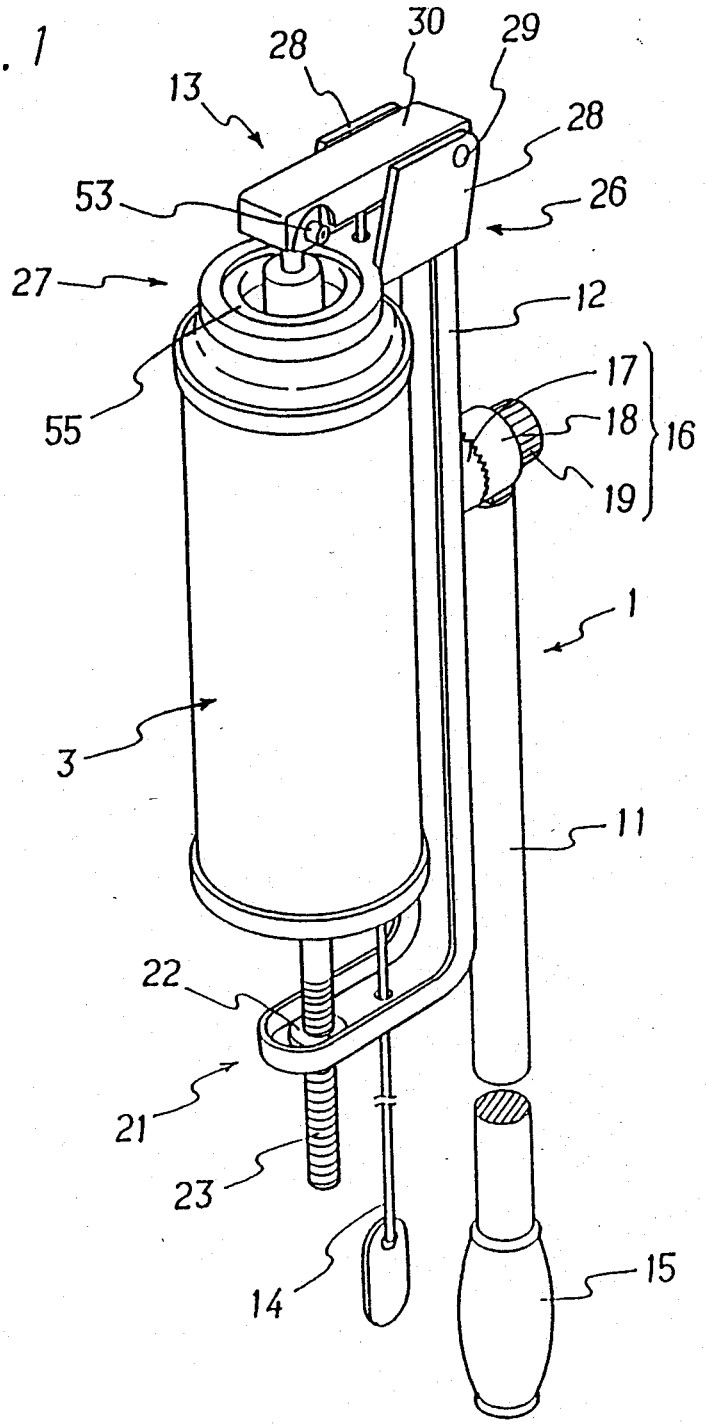
FIG. 1 is a perspective view showing an assisting tool 1 as a first embodiment of the present invention.

Referring to FIG. 1, numeral 1 denotes an assisting tool according to the first embodiment of the present invention, and numeral 3 denotes a sprayer or spray device. Before description of the assisting tool 1, now the spray device 3 is described hereinafter.

Any spray device on the market can be attached to the assisting tool of the invention. Such a spray device has generally a pressure container 51, and the pressure container 51 is filled with a compressed gas or propellant and a material to be sprayed. A pushbutton 52 is mounted on the upper end of the pressure container 51, and the pushbutton 52 is provided with a spray nozzle 53. The lower end of the pushbutton 52 is connected with an ejecting valve which is contained in the pressure container 51 through a stem, so that the material to be sprayed sprayed out of the nozzle 53 when the pushbutton 52 is pushed down to open the ejecting valve.

The numeral 54 denotes a cap, and the cap 54 is generally put on a neck portion 55 situated at the upper end of the pressure container 51. The cap 54 is however removed when the spray device 3 is used together with the assisting tool 1 of the present invention.

Figure 2:
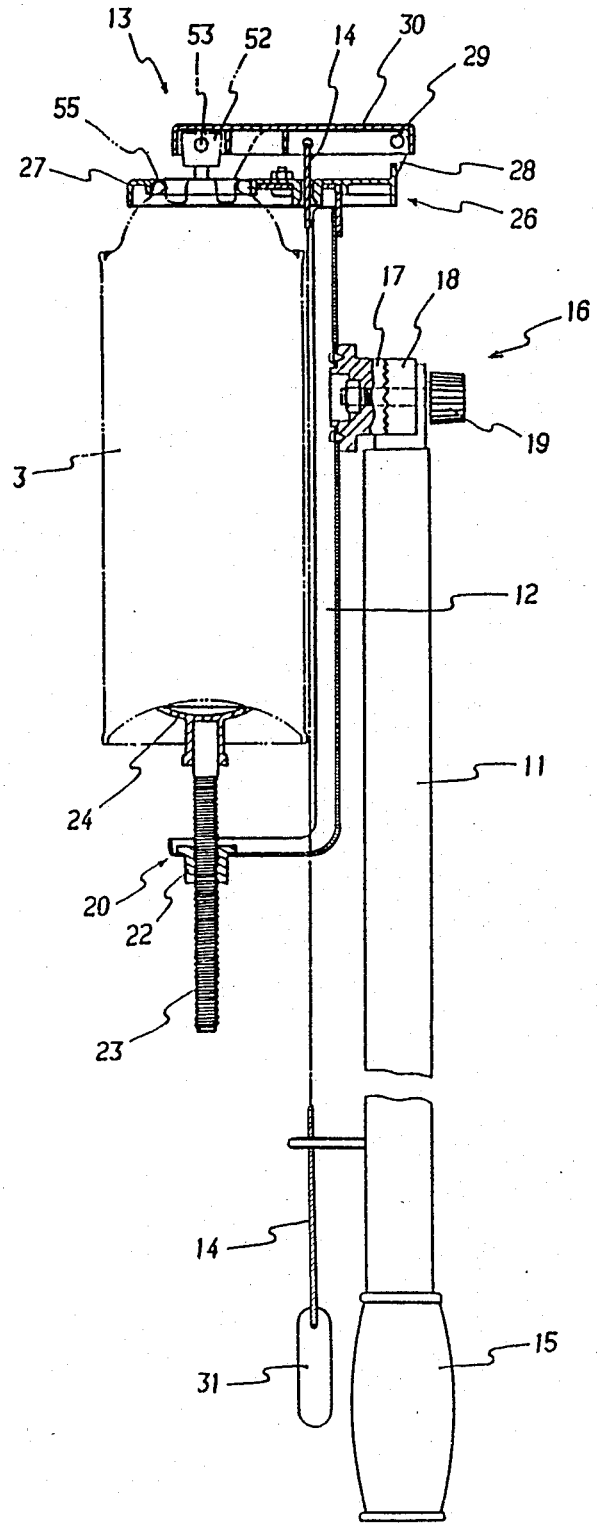
FIG. 2 is a partial sectioned side view of the same tool 1.
Figure 3:
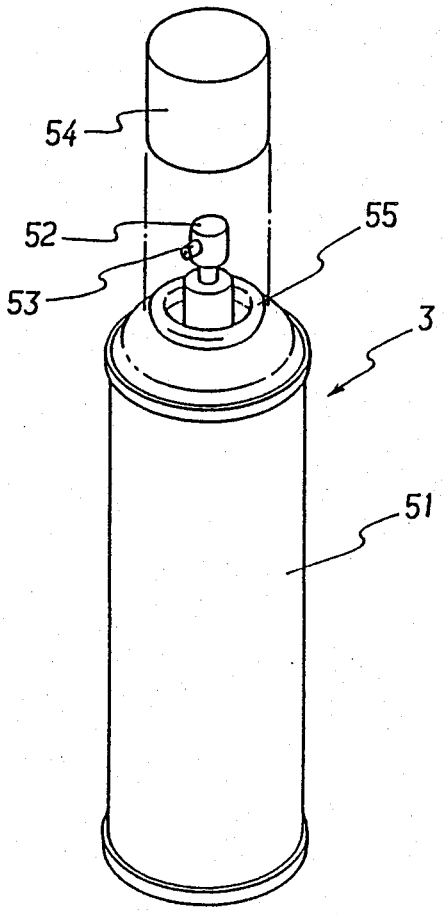
FIG. 3 is a perspective view showing an example of a spray device to be used in the tool of the present invention.
Figure 5:
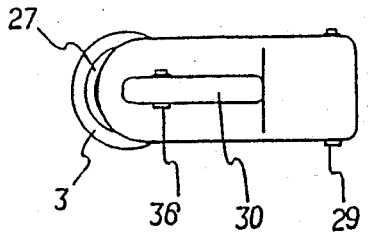
FIG. 5 is a plan view of the same assisting tool 2.

Now referring to FIG. 1 again, numeral 11 denotes a pole, 12 denotes a holder for holding the spray device 3, 13 denotes a valve-opening mechanism and 14 is a string as an operating means. Hereinafter, referring to also FIG. 2, the details are explained.

The pole 11 is made of a pipe having a length of 1 to 5 m, and is provided with a grip 15 at the lower end thereof. On the upper end of the pole 11, the holder 12 is attached in a rotatable manner through an attaching member 16. The attaching member 16 comprises, for example, a holder-side clip member 17 having radially serrated portion, a pole-side clip member 18 having radially serrated portion capable of engaging with the serrated portion of the clip member 17, and a bolt 19 for jointing the clip members 17 and 18 with each other.

The holder 12 has an L-shaped side view, and has a U-shaped cross section. The lower part of the holder 12 extends in the horizontal direction as a lower holder 21.

A nut 22 is fixed on the lower holder 21 and a bolt 23 is screwed through the nut 22.

A vacuum cup or suction cup 24 having a dish-like shape made of a soft synthetic resin or rubber is attached on the upper end of the bolt 23.

The holder 12 is provided with an upper holder 26 at the upper portion thereof. The upper holder 26 has a ring-shaped fitting portion 27 for holding a neck portion 55 of the spray device 3 at the front side thereof and has walls 28 at the rear side. The spray device 3 is held by fixing the neck with the fitting portion 27 and pressing the under surface with the suction cup 24. Pressing force can be adjusted by screwing the bolt 23 into the nut 22.

A support pin 29 passes through the walls 28 and a lever 30 is rotatably supported with the supporting pin 29. The front end of the lever 30 abuts against the pushbutton 52 of the spray device 3. The lever 30, the supporting pin 29 and the walls 28 constitute a valve-opening mechaism.

A string 14 has an upper end connected with the middle portion of the lever 30 and a lower end connected with a tag plate 31. When the string 14 is pulled down, the lever 30 is rotated to push the pushbutton 52 and therefore to open the valve of the spray device 3.

In the first embodiment, when the pole 11 is gripped with user's hands and is raised up, the spray device 3 can be situated at a high position. Therefore, the user can conveniently perform spray work at an object in the high position, e.g. a tall tree, by only directing the spray nozzle at the object and pulling the string 14 for spraying the mist, e.g. the mist of insecticide.

When the user intends to change the spraying angle, such change can be easily performed by untightenning the bolt 19 and by shifting the engaging position between the clip members 17 and 18.

The direction of the spray nozzle 53 is not limited to the side direction as shown in the drawings, but may be directed to the front or to the opposite side.

Second Embodiment

Figure 4:
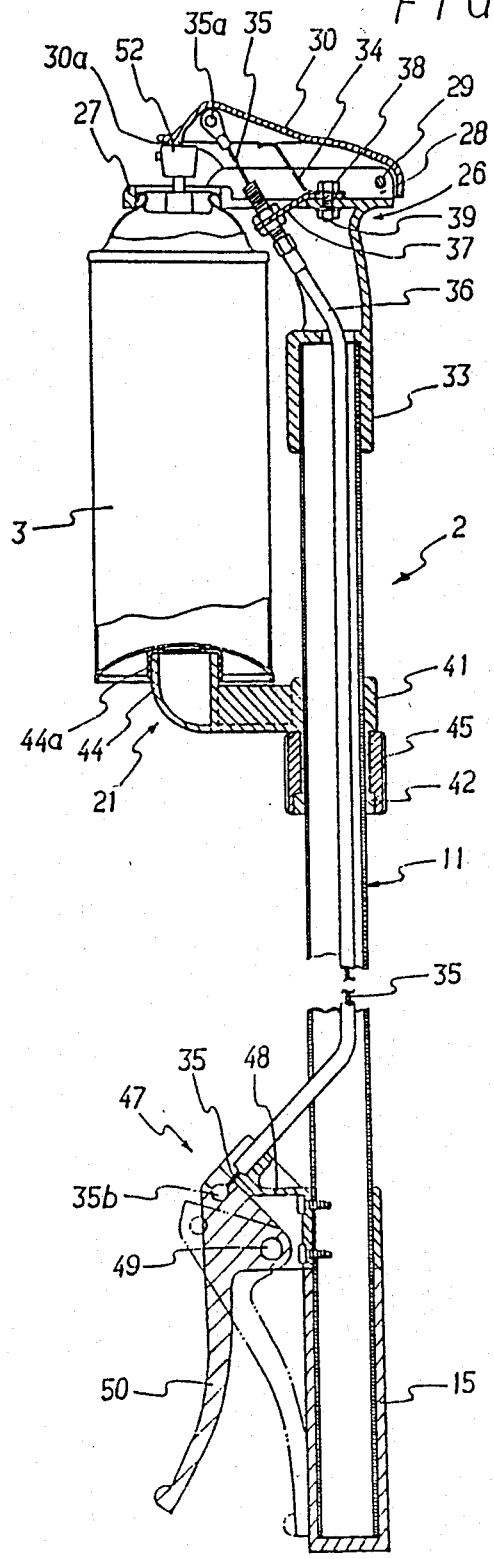
FIG. 4 is a longitudinal sectional view of an assisting tool 2 as a second embodiment of the present invention.
Figure 6:
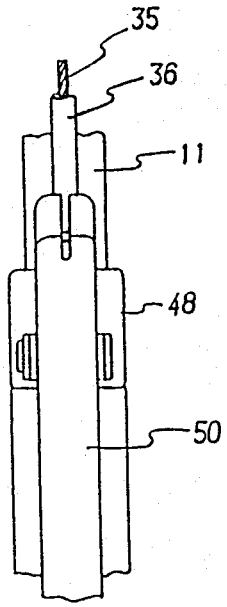
FIG. 6 is a front view of a lever in the same assisting tool 2.
Figure 8:
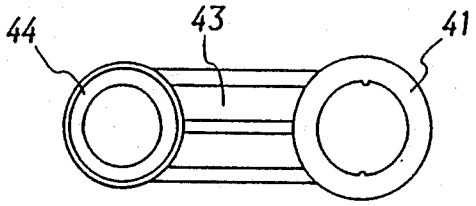
FIGS. 7, 8 and 9 are a longitudinal sectional view, a plan view and a side view, respectively, showing a lower holder of the same assisting tool 2.
Figure 9:
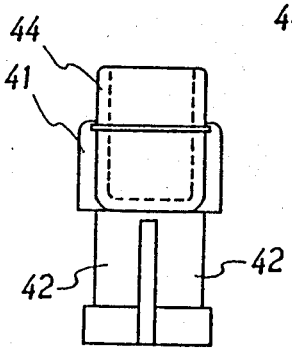
Figure 7:
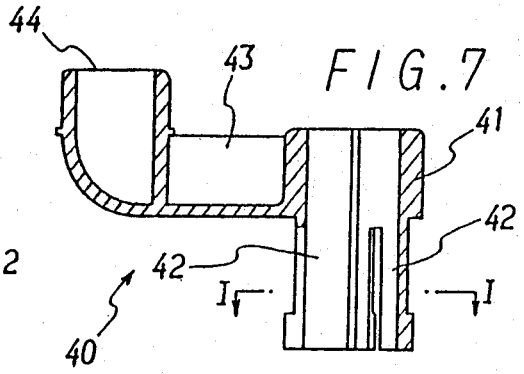
Figure 10:
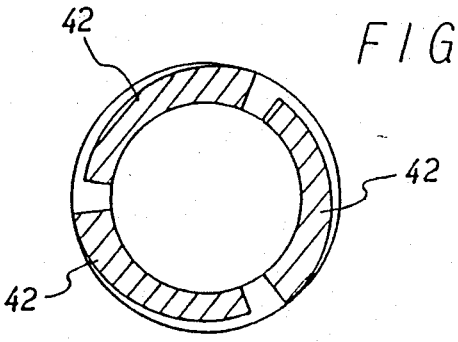
FIG. 10 is a sectional view along a line I—I in FIG. 7.

Referring to FIG. 4, the pole 11 is the same as that of the first embodiment. The pole 11 is provided with a grip 15 at the lower end thereof and an upper holder 26 at the upper end thereof, respectively. The upper holder 26 has an external appearance like a pistol and has a tubular portion 33 at the lower end thereof. The tubular portion 33 is fixed on the upper end of the pole 11. A fitting portion 27 of the upper holder 26 is the same as that of the first embodiment. The upper holder 26 has walls 28 and a supporting pin 29 passing through the walls 28. Further, a lever 30 is attached so that the lever can rotate around the supporting pin 29. The front end of the lever 30 is in contact with a pushbutton 52. The numeral 30*a* in FIG. 4 denotes a raised portion for adapting the lever 30 to various types of spray device 3 provided with each pushbutton 52 having various shape and height. Between a root portion of the upper holder 26 and the lever 30, a leaf spring 34 for elastically urging the lever upward is inserted.

In the second embodiment, a control cable or Bowden cable is employed as an operating means. The control cable comprises an inner cable 35 and a conduit 36, and the inner cable 35 has an end fixed to the lever 30 by means of a pin 35*a*. The conduit 36 is supported by a stay 37, and the stay 37 and an end of the leaf spring 34 are clamped with each other by means of a bolt 38 and a nut 39.

A lower holder 21 has a construction shown in FIGS. 7 to 12.

Now a body 40 is explained with reference to FIGS. 7 to 10. The body 40 has a tubular portion 41 to be mounted on the pole 11 and three tongue-like pieces 42 extending from the lower end of the tubular portion 41. The thickness of each tongue-like piece 42 is gradually changed in the circumference direction. The tubular portion 41 has a laterally extending arm 43, and the arm 43 is provided with a receiving member 44 at the end thereof. In general case, a rubber made cap (44*a* in FIG. 4) is set on the receiving member 44.

Figure 11:
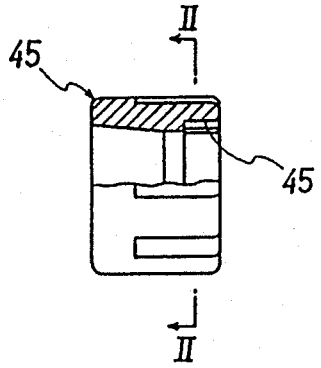
FIG. 11 is a partially sectioned side view of a gripping member of the same assisting tool 2.
Figure 12:
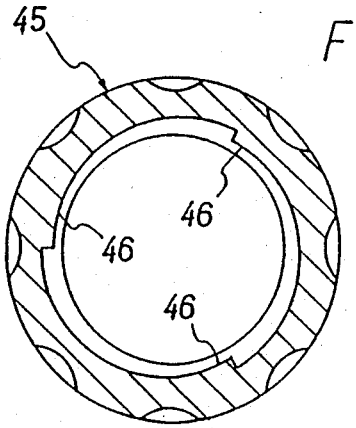
FIG. 12 is a sectional view along line II—II in FIG. 11.

FIGS. 11 and 12 show a clamping member 45 having three clamping portions 46 with each inner surface changing gradually the distance from the center of the clamping member 45. That is to say, each inner surface of the clamping portions 46 is a cam surface. As shown in FIG. 4, when the clamping member 45 is set around the tongue-like pieces 42 before the pole 11 is inserted into the lower holder 21 and is rotated in a certain angle after the pole 11 is inserted, the tubular portion 41 of the lower holder 21 is fixed on the outer surface of the pole 11 since the three tongue-like pieces 42 are inwardly elastically bent so as to narrow the inner diameter thereof. Additionally, when a spray device 3 is set on the tool 2 as shown in FIG. 4, the bottom of the spray device abuts against the receiving member 44. That is, the receiving member 44 abuts against the center of the lower surface of the spray device 3. The reaction force applied to the receiving member 44 by the weight of the spray device is transmitted to the tubular portion 41 of the holder through the laterally extending arm 43. This lever-and-fulcrum reaction through the laterally extending arm assists the tubular portion to firmly grip the pole. Therefore, by fixing the lower holder 21 on the pole 11 at a suitable position in accordance with the height of the spray device 3, any size of spray device 3 can be easily set on the upper end portion of the pole 11.

The above-mentioned inner cable 35 and conduit 36 of the control cable extend along the pole 11 to the lower end of the pole 11. A lever mechanism 47 is attached on the lower end of the pole 11. The lever mechanism 47 comprises a hand lever 50 rotatably supported on an attaching portion 48 by a pin 49. The lower end of the inner cable 35 is fixed with the hand lever by utilizing a nipple 35*b*. Therefore, by gripping the hand lever 50 to pull the inner cable 35, the lever 30 can be rotated downwards. When the upper lever 30 is rotated downwards, the spray device 3 sprays, and when the hand lever 50 is released, the lever 30 returned to the original position and the spray operation is stopped.

In the second embodiment, user's hand which grips the pole 11 can serve to operate the hand lever 50. That is to say, the user can operate the assisting tool with his only one hand. Therefore, the other hand can be served for another tool to be used in the spray work, for example, a mop, a brush, a painting roller or a scraper. Those tools can be fixed to the pole 11 on the back side opposite to the spray device.

Figure 13:
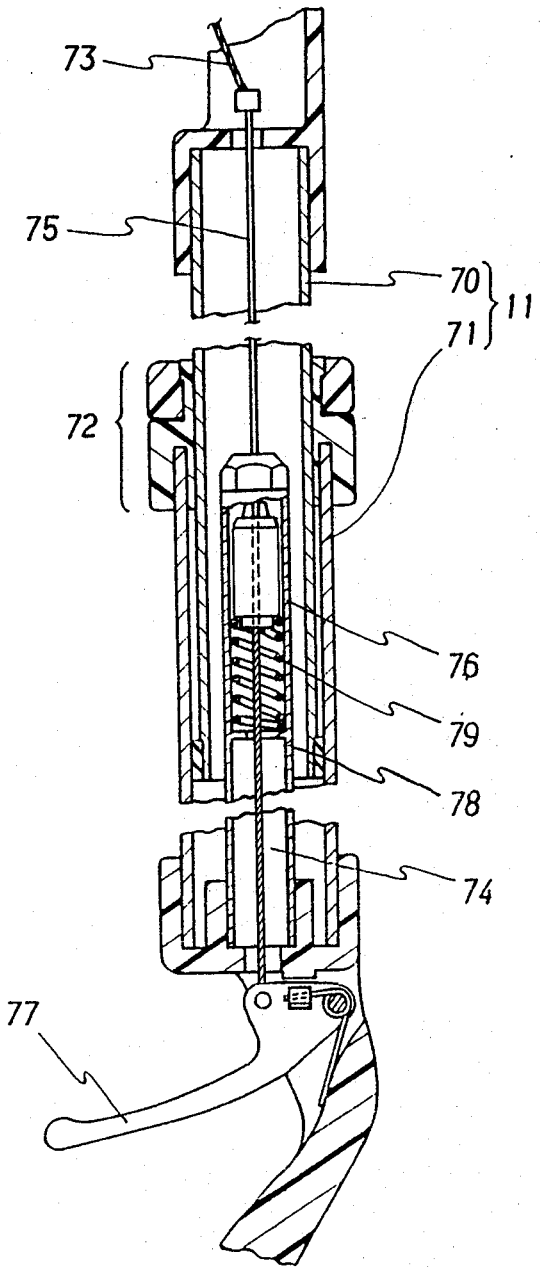
FIG. 13 is a sectional view showing an embodiment of an extension-contraction mechanism in the assisting tool of the present invention.

FIG. 13 shows a pole 11 comprising an upper pole 70 and a lower pole 71 which are combined in a telescopic manner so that the total length of the pole 11 can be expanded and contracted. At the portion where the upper pole 70 and the lower pole 71 are jointed, there is provided a locking means 72 which may have, for example, the same mechanism as that of the lower holder 21 (see FIGS. 8 to 12). Therefore, the total length of the pole 11 can be adjusted to a suitable length and can be locked in the state by means of the locking means 72.

Since the pole 11 has a telescopic function, the length of the means for operating the valve-opening mechanism, e.g. a cable, is also required to be adjustable in accordance with the total length of the pole 11. In the example of the pole 11 shown in FIG. 13, the cable for operating the lever (30 in FIG. 4) is separated into an upper cable 73 and a lower cable 74, and a relatively rigid wire rod such as a piano wire 75 and a chuck 76 capable of catching the piano wire 75 are inserted between the upper cable 73 and the lower cable 74. That is to say, in the device of FIG. 13, the upper cable 73 and the lower cable 74 are connected with each other as occasion demands, i.e. when the lower cable 74 is pulled, and therefore, the above-mentioned requirement is satisfied. The lower end of the lower cable 74 is connected to a hand lever 77 which is rotatably mounted on the lower end of the lower pole 71 in the same manner as mentioned in FIG. 4.

The chuck 76 is inserted in a pipe 78 which is coaxially arranged in the lower pole 71 so that the chuck 76 can axially move, and is usually urged upward by a spring 79 set in the pipe 78.

Figure 14:
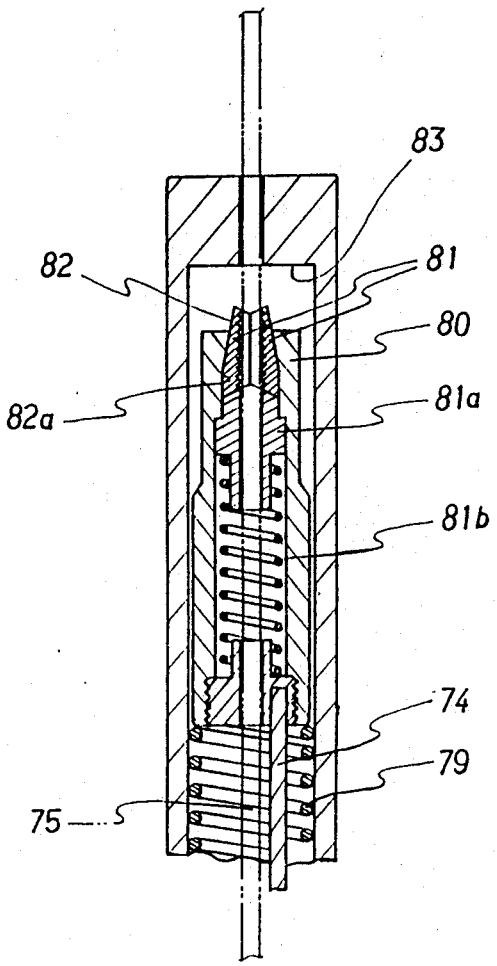
FIG. 14 is an enlarged sectional view of a chuck shown in FIG. 13.

For example, as shown in FIG. 14, the chuck 76 comprises a tubular member 80 which is directly urged upward by the spring 79, a pair of catch pieces 81 inserted in the tubular member 80 in an axially movable manner, a wedge member 81*a* disposed under the catch pieces 81 and an inner spring 81*b* for urging the wedge member 81 upward. The pair of catch pieces 81 has a wedge surface at the lower portion thereof which is abutting against the wedge surface of the wedge member 81*a*. The pair of catch pieces 81 has also a conically tapered surface 82 at the periphery thereof, and the tapered surface 82 is in contact with the inner conical surface 82*a* of a hole formed in the upper end of the tubular member 80.

In the usual state, i.e. when the lower cable 74 is not pulled, the tubular member 80 is pushed upward by the spring 79, and the tips of the catch pieces 81 abut against the lower surface 83 of the upper end of the pipe 78. Then the catch pieces 81 are pressed into the tubular member 80. Therefore, the tapered surfaces 82 of the catch pieces 81 and the inner conical surface 82*a* of the tubular member 80 are not in contact with each other. Then the inwardly directing force for closing the pair of catch pieces 81 becomes loose, and the wedge member 81*a* acts to separate the pair of catch pieces 81 from each other.

When the tubular member 80 is pulled through the lower cable 74, the tips of the catch pieces 81 come out of the hole of the tubular member 80, and then the tapered surfaces 82 and 82*a* come in contact with each other, thereby closing the catch pieces 81.

Accordingly, in a usual state, the rigid piano wire 75 can be freely moved in the axial direction through the chuck 76 since the catch pieces 81 are opened, and the upper pole 70 and the lower pole 71 can be telescopically slided.

On the contrary, when the hand lever 77 is pulled, since the chuck 76 catches the piano wire 75 at the same time, the piano wire 75 is pulled down against the urging force of the spring 79. Then the spray device is operated to spray through the upper cable 73.

When the hand lever 77 is released to stop the spray work, the chuck 76 returns upward by means of the spring 79, and the chuck 76 releases the piano wire 75 at the upper end of the axial stroke thereof.

The mechanism of the chuck 76, however, is not limited to the above-mentioned mechanism, but various types of mechanisms so far as having the above-mentioned function can be employed in the tool of the present invention.

Figure 15:
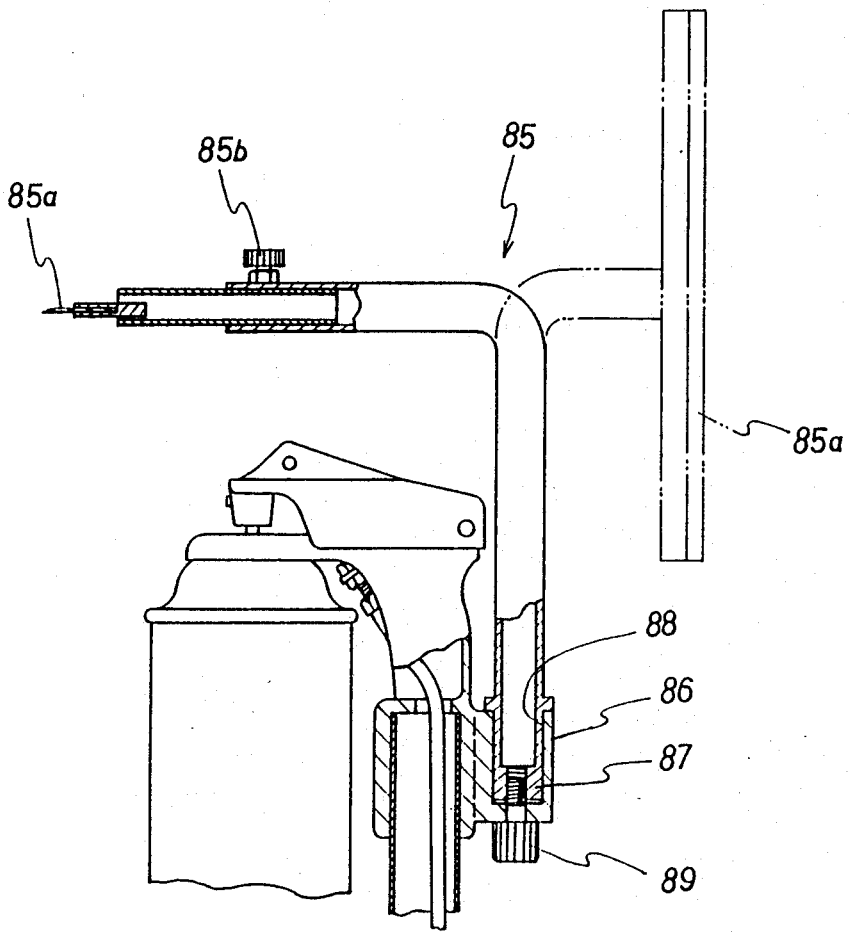
FIG. 15 is a partial sectional view showing a method for attaching an attachment used together with the assisting tool of the present invention.

The assisting tool shown in FIG. 15 is provided with an attaching portion 86 for detachably holding various accessory or attachment which are used together with the spray work, for example, a scraper 85 for glass pane cleaning spray work.

The attachment such as the scraper 85 can be directed to the same direction as that of a spray nozzle or in the opposite direction as shown with imaginary lines. If required, the attachment can be directed in the lateral or upper side.

In the embodiment of the assisting tool shown in FIG. 15, the scraper 85 can be fixed to an attaching portion 86 of the upper holder 26 by inserting the lower end portion 87 (see FIG. 16) having a circular or rectangular cross section into a hole 88 having a bottom thereof and by screwing a bolt 89 through a bolt-hole formed in the bottom of the hole 88. However, configuration of the attaching portion 86 and the attaching manner are not limited to the above-mentioned case.

The scraper 85 shown in FIG. 15 has a rubber blade 85*a* and is used when a glass plane is cleaned with spraying glass cleaner. The length and angle of the top portion of the scraper 85 may be adjustable by means of a bolt 85*b* or the like.

Figure 16:
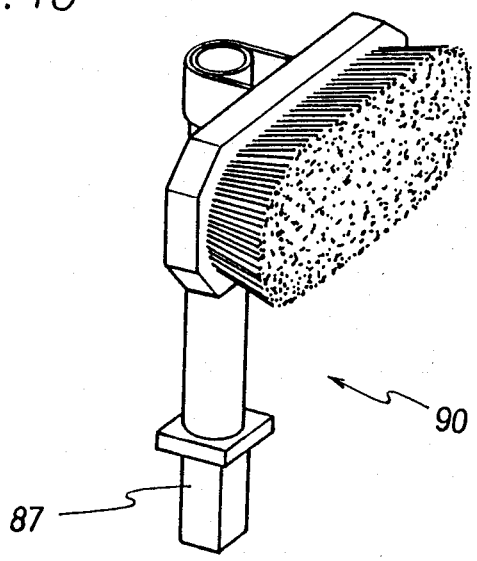
FIGS. 16 to 19 are perspective views showing another attachment used together with the assisting tool of the present invention.
Figure 17:
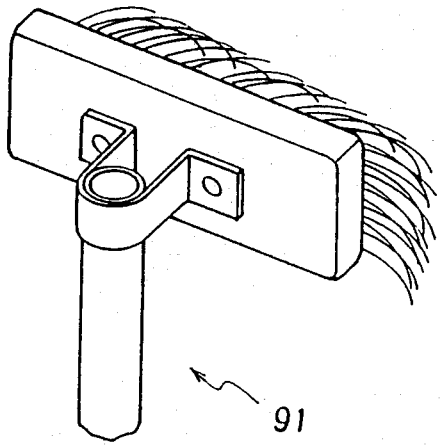

A brush 90 shown in FIG. 16 and a mop 91 shown in FIG. 17 are used when washing and cleaning the ceiling, the wall and the like.

Figure 18:
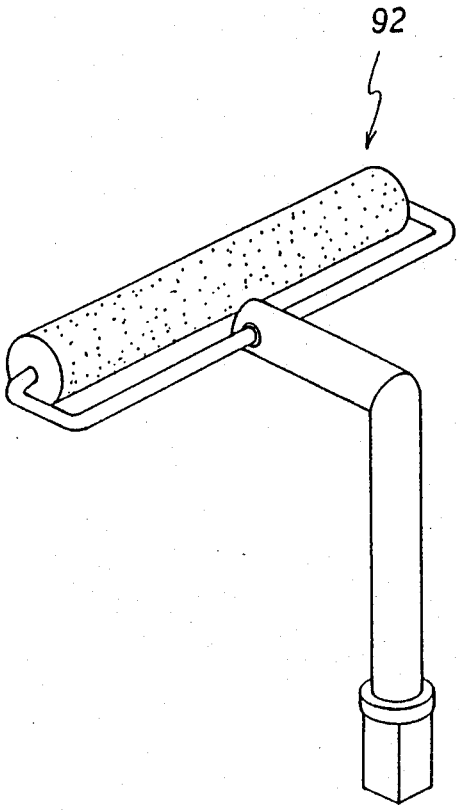

A roller 92 shown in FIG. 18 is used for evening a coat of paint after a surface is coated with a paint spray or the like.

The above-mentioned scraper, brush, mop, roller and the like can comprise an exchangeable top portion and a common handle portion.

Figure 19:
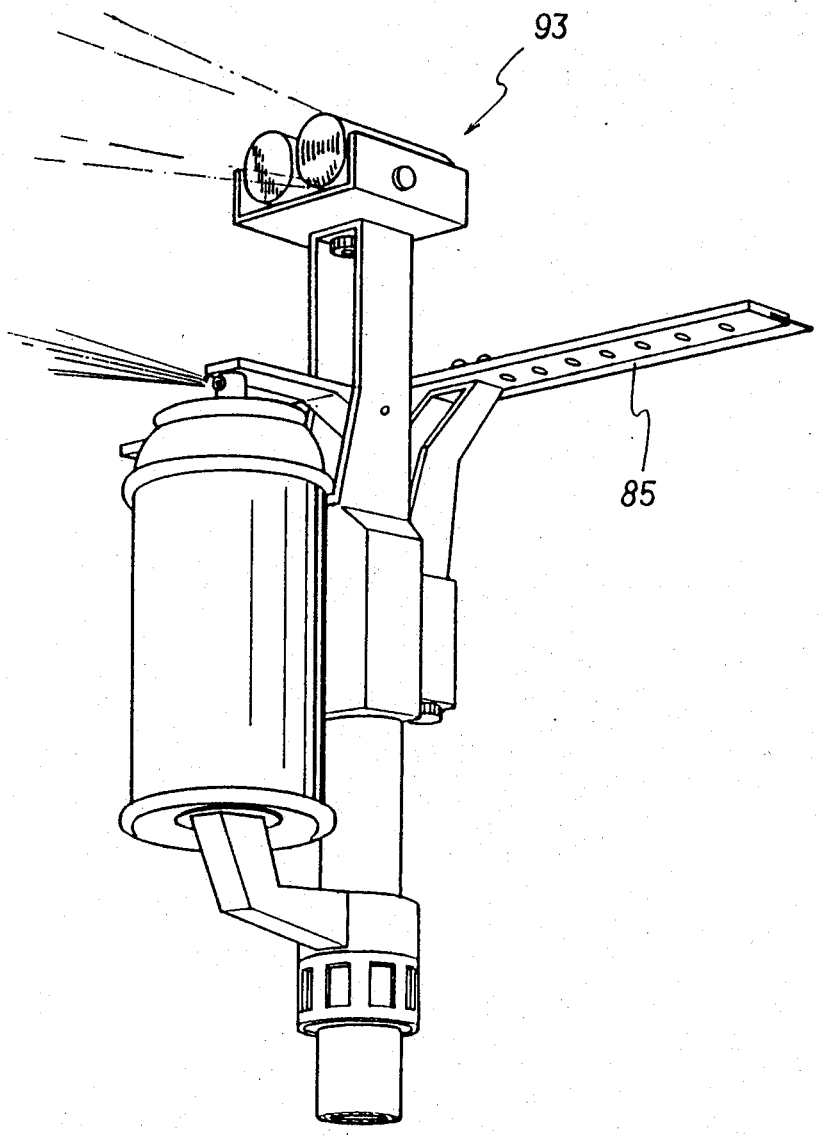

A pair of lights 93 shown in FIG. 19 is also an attachment for the assisting tool of the present invention. The lights 93 are used for flashing over the objects when spraying or using another attachments. In the example shown in FIG. 19, there are employed a set of lights, i.e., a front-directed light and a rear-directed light.

Though several embodiments of the invention are described with reference to drawings, it is to be understood that the present invention is not limited to the above embodiments, and various changes and modifications may be made in the invention without departing from the spirit and scope thereof.

What we claim is:

1. A tool for assisting spray work at a high position, comprising:

a pole;

an upper holder being fixed on an upper end of said pole, laterally extending and having a fitting portion for holding a neck portion of a spray device, said fitting portion having a circular through hole through which said neck portion is to be inserted such that said fitting portion abuts upon a semi-spherical portion of said neck portion;

a lower holder having a tubular portion slidably mounted on said pole, an arm laterally extending from said tubular portion and an elevated receiving portion provided at a free end of said arm for supporting a concaved lower surface of said spray device, said elevated receiving portion having a diameter substantially smaller than that of said spray device;

a clamping means for fixing said tubular portion on said pole;

a valve-opening mechanism for opening an ejecting valve of said spray device; and an operating means for remotely operating said valve-opening mechanism from a lower end portion of said pole.

2. The tool of claim 1, wherein said operating means comprises a connecting means for operating said valve-opening mechanism.

3. The tool of claim 1, wherein said operating means comprises a control cable and a hand lever for enabling a pull operation by an inner cable of said control cable.

4. The tool of claim 1, wherein said tubular portion has a flexible lower portion having an outer surface provided with at least a first cam surface and said clamping means is a ring member slidably mounted on said pole for fixing said lower portion of said tubular portion on said pole, said ring member has an inner surface provided with at least a second cam surface engagable with said first cam surface of said lower portion of said tubular portion.

5. The tool of claim 4, wherein said lower portion of said tubular portion has a plurality of tongue-like pieces, each tongue-like piece extending downwardly and having elasticity and thickness gradually changing in circumferential direction in order to form a plurality of said first cam surfaces and wherein said ring member has said inner surface provided with a plurality of said second cam surfaces and further wherein a distance of each of said second cam surfaces from a center thereof is gradually changed so that each of said second cam surfaces corresponds to each of said first cam surfaces of said tongue-like pieces.

* * * * *